United States Patent [19]

Stoll et al.

[11] Patent Number: 4,856,104

[45] Date of Patent: Aug. 8, 1989

[54] DEVICE FOR THE DISPLAY AND EDITING OF KNITTING PATTERNS PRODUCED ON A FLAT-BED KNITTING MACHINE

[75] Inventors: Thomas Stoll; Martin Killus; Gerd Mak, all of Reutlingen, Fed. Rep. of Germany

[73] Assignee: H. Stoll GmbH & Co., Reutlingen, Fed. Rep. of Germany

[21] Appl. No.: 92,544

[22] Filed: Sep. 3, 1987

[30] Foreign Application Priority Data

Sep. 10, 1986 [DE] Fed. Rep. of Germany ..... 3630828

[51] Int. Cl.[4] ..... D04B 15/66

[52] U.S. Cl. ..... 364/470; 66/232; 66/237

[58] Field of Search ..... 364/470; 64/232, 237

[56] References Cited

U.S. PATENT DOCUMENTS

| | | | |
|---|---|---|---|
| 3,890,806 | 6/1975 | Grozinger | 66/232 |
| 4,018,064 | 4/1977 | Doslik | 66/232 |
| 4,479,368 | 10/1981 | Gloeckler | 364/470 |
| 4,608,642 | 8/1986 | Shima | 364/470 |

*Primary Examiner*—A. D. Pellinen
*Assistant Examiner*—Jeffrey A. Gaffin
*Attorney, Agent, or Firm*—Jones, Tullar & Cooper

[57] ABSTRACT

A device for the display and editing of knitting patterns to be produced by means of a flat-bed knitting machine has an image memory containing the knitting pattern loop by loop in an arrangement by lines and columns, which is on its input side connected with a horizontal and a vertical address counter and on its output side with a monitor, furthermore a CPU for the programmed control of the image memory and of the monitor, and a data entry device. In order to obtain in such a device a change in the knitting pattern, especially the stretching of loops, in a simpler and quicker way and with a lesser need for memory locations, a device is provided for the pre-determined change by line or point of at least parts of the data content read from the image memory, in which image memory a memory location each is associated with a corresponding loop of the knitting pattern, as well as for displaying of both the changed part of the data content and the unchanged part of the data content on the monitor.

10 Claims, 2 Drawing Sheets

DEVICE FOR THE DISPLAY AND EDITING OF KNITTING PATTERNS PRODUCED ON A FLAT-BED KNITTING MACHINE

FIELD OF THE INVENTION

The present invention relates to a device for the display and editing of knitting patterns preferably produced on a flat-bed knitting machine with an image memory containing the knitting pattern by loops in a linear and columnar arrangement which is connected on the input side with a horizontal and vertical address counter and on the output side with a monitor, a CPU for the programmed control of the image memory and the monitor and with an input device.

BACKGROUND OF THE INVENTION

Presently knitting patterns for use on flat-bed knitting machines or circular knitting machines are drafted on the monitor or screen of a so-called VDU (video display unit). In such a VDU comprising a device of the type mentioned above, the knitting pattern is drafted on the monitor with the aid of an input device in the form of a keyboard and is stored in the image memory after completion. It is necessary for the purpose of as exact a reproduction of the form and proportions of the loops as possible as well as for an approximation of the three-dimensional cut and shape of the knitted fabric as it is being worn, to be able to stretch parts of the loops of a knitting pattern in different ways. While, in the latter case, this depends on the three-dimensional shape of the knitted fabric as it is being worn, for the proportions of the individual loops it depends on the fineness of the machine, the thickness of the yarn, the closeness, the type of knit, the casting off of the goods and the like or it is determined by these factors.

For example, the stretching of loops has up to now been done by displaying or storing each loop by a plurality of image points on the monitor or memory points in the image memory. If, for example, for displaying a loop a ratio of three image points in a horizontal direction and five image points in a vertical direction on the monitor is selected, this one loop is stored in the image memory in three times five, i.e., fifteen memory locations. This requires, on the one hand, a relatively large image memory and, on the other hand, a relatively complicated input procedure. If such a knitting pattern, at first only available as a draft, is to be changed, this is relatively complicated if the proportion of loops is to be changed in particular areas or overall, because it is necessary to change each individual loop, i.e., the fifteen image points or memory locations. This not only entails considerable effort but also the time needed for this plays a relatively important role. It is necessary to reprogram the entire image memory with these new proportions or dimensions of the individual loops. The knitting pattern is maintained in the image memory as a true representation and the depiction or display on the monitor is an exact reproduction of the contents of the memory.

SUMMARY OF THE INVENTION

It is an object of the present invention to provide a device of the type mentioned above in which the changes in the knitting pattern, especially the stretching of loops, is possible in a more simple and faster manner and with a lessened requirement for memory locations.

To attain this object in a device of the type mentioned a device is provided for the pre-determined change by line or point of at least parts of the data content read from the image memory, in which image memory a memory location each is associated with a corresponding loop of the knitting pattern, as well as for displaying of both the changed part of the data content as well as the unchanged part of the data content on the monitor.

In accordance with the present invention the data content of the image memory which contains the knitting pattern per se is separated from the capability of zooming, i.e. to stretch the individual loops by a set whole number factor. In other words, only a single memory location is assigned to each loop in the image memory, so that the memory location capacity can be reduced to a minimum. The stretching of the loops is performed with the read-out of the knitting pattern entered and stored in the image memory. The change is preset as desired, the presetting being possible in different ways, i.e. the proportions by which the loops are to be stretched are freely selectable, taking into consideration a whole number multiple for the line and/or the individual point on a line, respectively. This means that a change of the proportions of the loops to be displayed can be made in a simple and quick way by a change of the respective device. Because of this change method the time needed for the change and transfer to the monitor is reduced. In an advantageous way the contents of the image memory, i.e., the basic pattern, remains.

In accordance with a preferred exemplary embodiment of the present invention the change of the data content read from the image memory takes place in accordance with a program in that, for the purpose of showing the individual loops of the knitting pattern stretched, a determination is made whether the data of a memory location in the image memory should be displayed two, three or more times on the monitor instead of once. This is done according to line as well as points by first reading, beginning at the upper left of the monitor, each memory location or point in the first line and then in the following line, etc., provided that the first line is not to be repeated according to the program.

By utilizing a programmable memory with which a point or line counter is associated, it is possible to program the device for the preset change of the readout data content in a quick and simple manner by line as well as points and thereby to change it in regard to the stretching factor.

A simple control of the image memory or of its address counters is achieved by directing the programmable memory to a gate circuit on its output side parallel with a clock signal line, the output signal of which determines wherein the data of the preceding memory location should be repeated or the data of the next memory location should be read from the image memory.

By connecting the output of the point counter with an input of the line counter a simple, line-by-line continuation or repetition of the preceding line is achieved during the read-out of the data content of the image memory.

Further details of the invention can be seen from the following description in which the invention is further described and explained in detail by means of the exemplary embodiment shown in the drawings.

DETAILED DESCRIPTION OF THE PREFERRED EMBODIMENT

Figure 1:
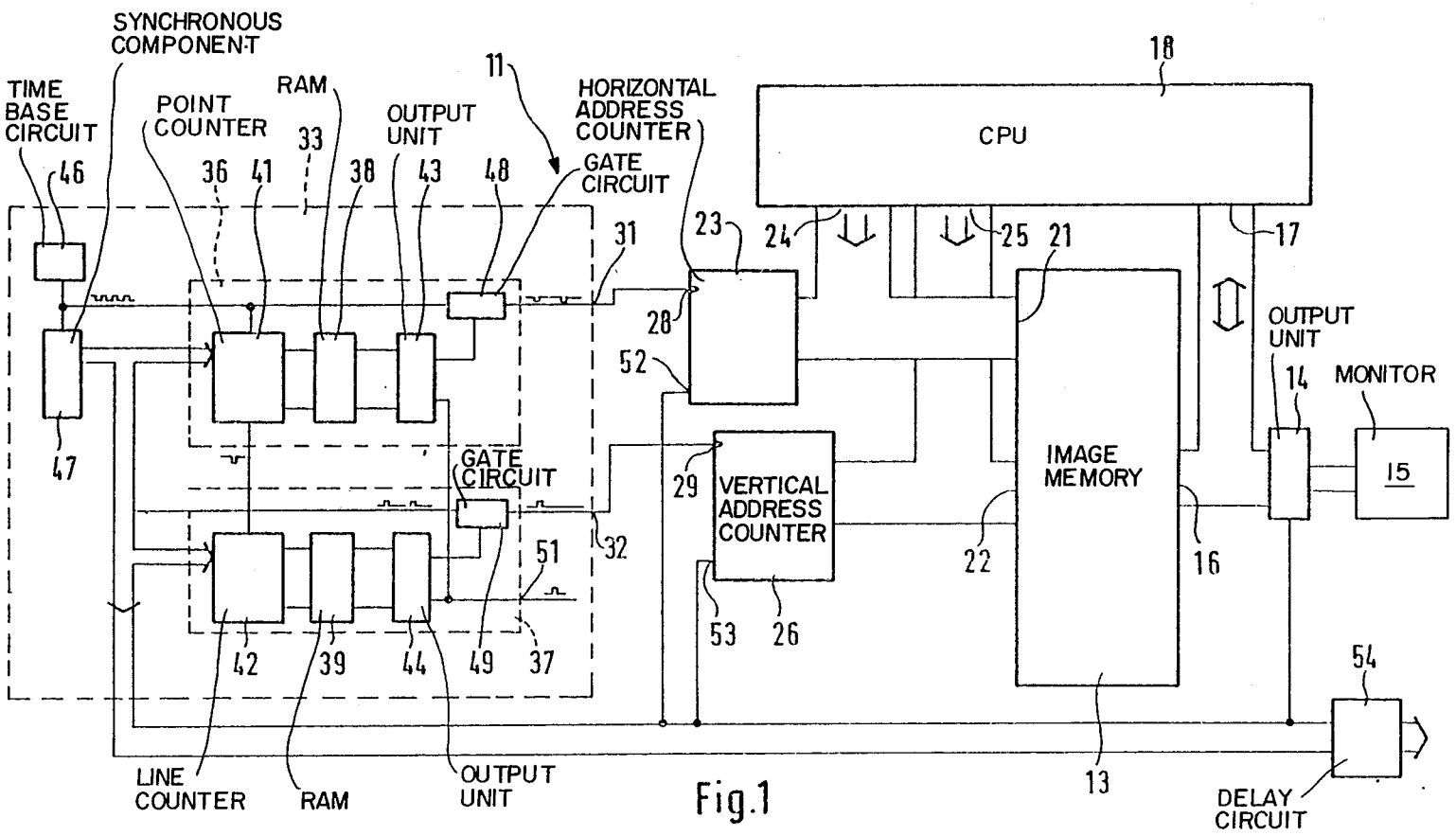
FIG. 1 is a block switching diagram of a device for the display and editing of knitting patterns in accordance with a preferred embodiment of the present invention.

The device 11 shown in FIG. 1 is used for the display and editing of knitting patterns 12 (FIGS. 2A and 2B) which are to be produced by means of a flat-bed knitting machine or a circular knitting machine. The device 11 has an image memory 13 in the form of a RAM memory, the data output 16 of which is connected via a parallel/serial output unit 14 with a monitor or screen 15. The data output 16 of the image memory 13 is further connected with the data output 17 of CPU (central processor unit) 18. An X-address input 21 of the image memory 13 is connected on the one side with the output of a horizontal address counter 23 and on the other side with an address output 24 of the CPU 18. Correspondingly, a Y-address input 22 of the image memory 13 is connected on the one side with the output of a vertical address counter 26 and on the other side with a second address output 25 of the CPU 18.

A first and second, respectively, output 31, 32 of a bit board device 33 for the preset changing of at least a part of the data content read out from the image memory 18 is connected with a clock input 28 of the horizontal address counter 23 and with a clock input 29 of the vertical address counter 26. This device 33 contains a so-called horizontal bit board unit 36 as well as a so-called vertical bit board unit 37. Each of these bit board units 36 and 37 has a memory in the form of a RAM memory 38 and 39, connected at the input side with the output of a point counter 41 or a line counter 42 and on the output side with the input of a parallel/serial output unit 43 or 44.

The device 33 further has a time base circuit 46 for the dissemination of periodically repeated clock pulses and a synchronous component 47, the output of which is connected with the reset input of the point counter 41 of the horizontal bit board unit 36 as well as with the reset input of the line counter 42 of the vertical bit board unit 37. On its output side the time base circuit 46 is connected with the clock input of the counter 41 of the horizontal bit board unit 36 and with the input of the gate circuit 48, the enable input of which is connected with a first output of the output unit 43 and the output of which comprises the first output 31 of the device 33. The time base circuit 46 is further connected via the synchronous component 47 with the input of the second gate circuit 49, the enable output which is connected with the output unit 44 of the vertical bit board unit 37 and the output of which comprises the second output 32 of the device 33. Furthermore a second output of the counter 41 of the horizontal bit board unit 36 is connected with the clock input of the counter 42 of the vertical bit board unit 37. Also, the two outputs of the output units 43 and 44 are connected with each other and a horizontal/vertical cursor signal can be picked up on their common output line 51.

The output of the synchronous component 47 is furthermore connected with the respective reset inputs 52, 53 of the horizontal and vertical address counters 23, 26 and directed to a second input of the parallel/serial output unit 14 as well as to an input of a delay circuit 54, the output of which is directed to the monitor or screen as synchronization.

The operation of the device 11 of the invention or the entering of a knitting pattern and the editing of the entered knitting pattern during display on the monitor or screen is as follows:

By means of an input device, not shown, for example in the form of an input keyboard, a knitting pattern 12 is drafted on the monitor, each image point of a loop being displayed and the individual image points preferably being marked in color by different symbols. Such a knitting pattern or draft of a knitting pattern displayed on the monitor is then stored in the RAM image memory 13, with a memory location in the image memory 13 assigned to each image point. The knitting pattern 12 thus stored in the RAM image memory 13 can, in this schematic form, be displayed at any time on the monitor.

Figure 2A:
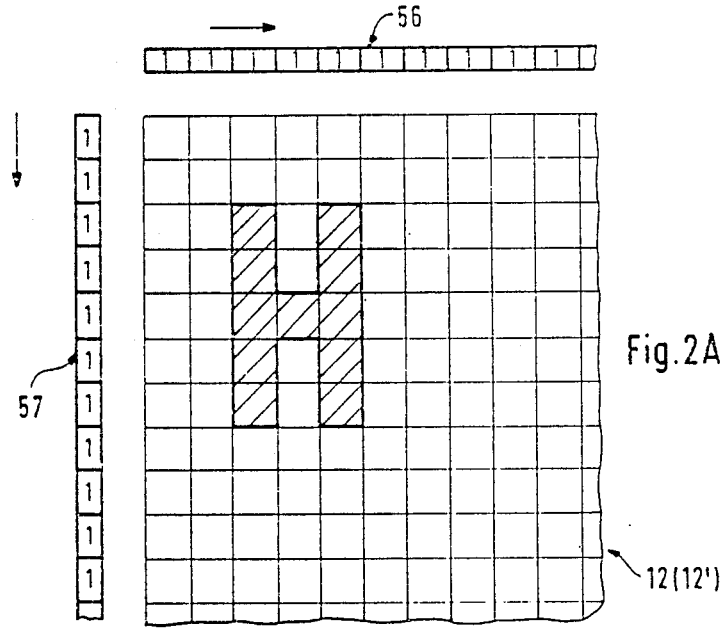
FIGS. 2A and 2B show by means of an example part of a knitting pattern in the non-stretched state as stored in the image memory and in the stretched state displayed on the monitor after read-out and editing.
Figure 2B:
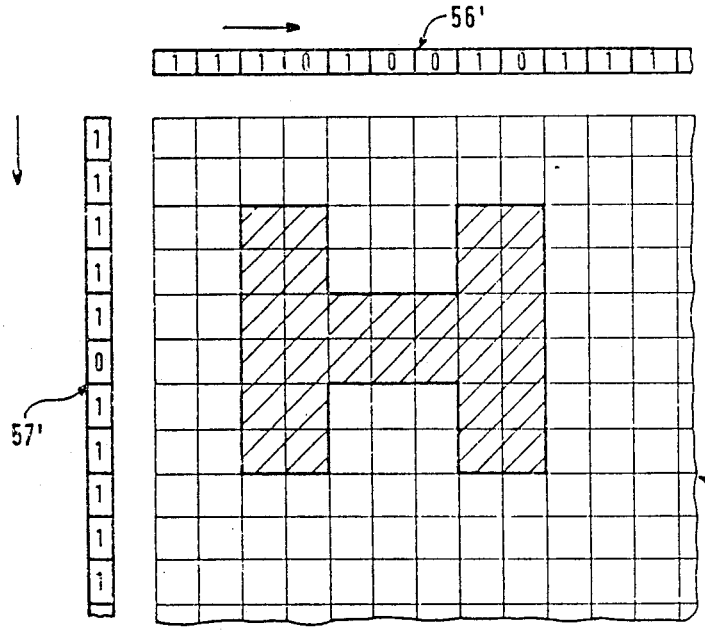

For a very similar or true to the completed knitting pattern 12' display of the knitting pattern 12 stored in the image memory 13 on the monitor, the stored knitting pattern is edited by means of the bit board device 33. For this purpose the individual loops are stretched in a horizontal and/or vertical direction in accordance with their actual proportions and/or in accordance with their proportions also appearing in depth on the finished knitted fabric, especially for the showing of contours or the like. As an example this has been shown in FIGS. 2A and 2B by means of the letter "H" in a knitting pattern 12 and 12', respectively. FIG. 2A shows an "H" displayed on the monitor which has only been stretched 1:1 with respect to the stored shape in the RAM image memory 13, i.e., it has been taken from the image memory unstretched. In contrast thereto FIG. 2B shows a stretching of the "H" stored in the image memory 13, its vertical line having been stretched by a factor of 2 in the horizontal plane, and the center crosspiece having been stretched by a factor of 3 in the horizontal plane and by a factor of 2 in the vertical plane. For this purpose the contents of the horizontal bit board 56 or 56' have been entered into and stored in the RAM memory 38 of the horizontal bit board unit 36, while the contents of the vertical bit board 57 or 57' have been entered into and stored in the RAM memory 39 of the vertical bit board unit 37. The entry of the respective bit board into the RAM memory 38 or 39 can also be done by means of the above mentioned, but not shown, entry keyboard, the changing of the data in the bit boards being done by simply writing over the data stored in the RAM memory 38, 39 up to now.

As mentioned above, the output of the logic gate circuit 48 or 49 indicates whether the data stored for the succeeding line or column should be retrieved from the RAM image memory 13 via the horizontal or vertical address counter 23 or 26 or whether the data stored in the image memory for this line or column should be repeated. A start is made with the first line, i.e. the data in the horizontal bit board for this line are being processed point by point in the horizontal RAM memory 38. As long as a "1" is written in the RAM memory 38, the clock pulse coming from the time base circuit 46 is admitted, so that the clock signal appearing at the first output 31 controls the horizontal address counter 23 such that new information or the data of the following point or memory location are read out and displayed on the monitor. However, if a "0" is written in the horizontal bit board of the horizontal RAM memory 38, no clock signal appears at the output of the first gate circuit 48, the horizontal address counter 23 being controlled such that no new data are being retrieved from the image memory 13, but the preceding information, i.e. the data of the preceding point or memory location are read out again and displayed on the monitor. This means that the respective loop has been displayed on the monitor stretched in the horizontal plane by a factor of 2. In this manner the horizontal bit board 56 is read point by point for the first line. At the end of this first line the horizontal address counter 23 is reset and a pulse directed by the horizontal counter 41 to the vertical counter 42 of the vertical bit board unit 37. If the vertical bit board 57 or 57′ of the vertical RAM memory 39 shows a "1" in the second line, the information of the horizontal bit board 56, 56′ corresponding to the data stored in the RAM image memory 13 for the second line are read out or edited. However, if a "0" appears in the vertical bit board 57 or 57′ for the second line, the data stored in the RAM image memory 13 in regard to the first line are read out again, edited and displayed on the monitor, taking into consideration the information in the horizontal bit board 56, 56′. This results in a stretching by a factor of 2 in the vertical direction of the corresponding loops. It is to be understood that the number of successive "0" in the horizontal or vertical bit board is a measurement for the whole number factor of the stretching in the horizontal or vertical direction. After all lines have been polled and edited, the vertical address counter 26 is reset. If the display does not appear to be sufficiently satisfactory or true to the operator, the memory contents of the RAM memories 38 and/or 39 or their bit boards 56, 56′ or 57, 57′ can be rewritten without the contents of the image memory 13 being changed.

It is to be understood that the exemplary embodiment described above has been given by way of example only and that further variants and improvements are possible within the scope of the invention.

What is claimed is:

1. A device for the display and editing of knitting patterns produced, preferably on a flat-bed knitting machine, comprising:

an image memory containing a knitting pattern, by loop, in a linear and columnar arrangement, an image memory locations being associated with a corresponding loop of the knitting pattern;

a horizontal address counter and a vertical address counter connected as inputs to the image memory, said image memory being connected on its output with a monitor;

a central processor unit connected to the image memory, the horizontal address counter and the vertical address counter for the programmed control of the image memory and the monitor; and a bit board device connected to the horizontal address counter and to the vertical address counter, said bit board device serving for the pre-determined change, by line or point, of at least part of the data content read from the image memory, such that both the changed part and the unchanged part of the data content is displayed on the monitor.

2. The device as defined in claim 1, wherein the bit board device includes a point counter and a programmable memory connected to the point counter for each point change, and a line counter and programmable memory connected to the line counter for each line change.

3. The device as defined in claim 2, further wherein an output of the point counter is connected with an input of the line counter.

4. The device as defined in claim 2, further wherein the bit board device further includes a time base circuit generating a clock signal, a gate circuit for receiving the clock signal and an outupt from the point counter programmable memory, the output signal from the gate circuit determining whether the data of a memory location should be read from the image memory.

5. The device as defined in claim 4, further wherein as output of the point counter is connected with an input of the line counter.

6. The device as defined in claim 1, wherein the bit board device determines, in accordance with a program, how often the data of each memory location in the image memory are read out and displayed on the monitor.

7. The device as defined in claim 6, further wherein the bit board device includes a point counter and a programmable memory connected to the point counter for each point change, and a line counter and a programmable memory connected to the line counter for each line change.

8. The device as defined in claim 7, further wherein an output of the point counter is corrected with an input of the line counter.

9. The device as defined in claim 7, further includes a time base circuit generating a clock signal, a gate circuit for receiving the clock signal and an output from the point counter programmable memory, the output signal from the gate circuit determining whether the data of the preceding memory location should be repeated or the data of another memory location should be read from the image memory.

10. The device as defined in claim 9, further wherein an output of the point counter is connected with an input of the line counter.

* * * * *